US007106286B2

(12) United States Patent
Baba et al.

(10) Patent No.: US 7,106,286 B2
(45) Date of Patent: Sep. 12, 2006

(54) LIQUID CRYSTAL DISPLAYING METHOD

(75) Inventors: Masahiro Baba, Kanagawa-ken (JP); Haruhiko Okumura, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 572 days.

(21) Appl. No.: 10/385,718

(22) Filed: Mar. 12, 2003

(65) Prior Publication Data

US 2003/0174110 A1 Sep. 18, 2003

(30) Foreign Application Priority Data

Mar. 12, 2002 (JP) ..... 2002-066645

(51) Int. Cl.
*G09G 3/36* (2006.01)

(52) U.S. Cl. ..... 345/88; 345/204; 345/89

(58) Field of Classification Search ..... 345/88–89, 345/204, 90, 100; 348/791–792
See application file for complete search history.

(56) References Cited

U.S. PATENT DOCUMENTS

| | | | | |
|---|---|---|---|---|
| 5,051,818 | A * | 9/1991 | Mishima | 348/668 |
| 5,119,084 | A * | 6/1992 | Kawamura et al. | 345/98 |
| 5,461,429 | A * | 10/1995 | Konishi et al. | 348/656 |
| 5,528,257 | A | 6/1996 | Okumura et al. | |
| 6,329,980 | B1 * | 12/2001 | Uehara et al. | 345/204 |

FOREIGN PATENT DOCUMENTS

| | | |
|---|---|---|
| JP | 6-46358 | 2/1994 |
| JP | 2000-330501 | 11/2000 |
| JP | 2002-062850 | 2/2002 |
| JP | 2002-082657 | 3/2002 |

* cited by examiner

*Primary Examiner*—Lun-yi Lao
(74) *Attorney, Agent, or Firm*—Oblon, Spivak, McClelland, Maier & Neustadt, P.C.

(57) ABSTRACT

A liquid crystal displaying method includes: multiplying, a difference value of luminance information and a difference value of color-difference information each by an emphasis coefficient α (α is a positive real number); adding the luminance information in which the input image information has been delayed for one frame period and the color-difference information in which the input image information has been delayed for one frame period to the difference value of the luminance information multiplied by the emphasis coefficient α and the difference value of the color-difference information multiplied by the emphasis coefficient α, respectively, to obtain emphasized image information. The difference value of the luminance information is the luminance information of the input image information having the luminance information and the color-difference information subtracted from the luminance information in which the input image information has been delayed for one frame period. The difference value of the color-difference information is the color-difference information of the input image information subtracted from the color-difference information in which the input image information has been delayed for one frame period.

13 Claims, 14 Drawing Sheets

LIQUID CRYSTAL DISPLAYING METHOD

CROSS REFERENCE TO RELATED APPLICATION

This application is based upon and claims the benefit of priority from the prior Japanese Patent Application No. 2002-66645, filed on Mar. 12, 2002, in Japan, the entire contents of which are incorporated by reference herein.

BACKGROUND OF THE INVENTION

1. Field of the Invention

The present invention relates to a liquid crystal displaying method, particularly relates to the displaying method which displays a high-quality moving picture including luminance information and color-difference information on a liquid crystal display, by using easy processing in which software can perform real-time processing.

2. Related Art

In recent years, a liquid crystal display is spread in wider fields such as monitors for personal computers, notebook computers, and televisions. Accordingly, an opportunity for viewing a moving picture by the liquid crystal display is greatly increased. However, in the liquid crystal display, since response speed of the liquid crystal is not sufficiently fast, degradation of image quality such as blurring or residual image occurs in displaying moving picture. Generally, since refresh rate of the liquid crystal display is 60 Hz, in order to correspond to the display of the moving picture, a target is the response speed of less than 16.7 ms. In recent liquid crystal displays, though the binary response speed (in the liquid crystal display of the display with 256-level gray-scale, from 0-level gray-scale to 255-level gray-scale or from 255-level gray-scale to of 0-level gray-scale) is less than 16.7 ms, the response speed between the intermediate gray-scale levels is more than 16.7 ms.

The problem that the response speed between the intermediate gray-scale levels is not sufficient because the general moving picture includes a large quantity of the response between the intermediate gray-scale levels results in the degradation of the image quality, so that it is necessary that the response speed is further improved.

In order to improve the response speed of the liquid crystal display, development of a new liquid crystal material having the fast response speed, improvement of a driving method of the liquid crystal display using the conventional liquid crystal material. For the new liquid crystal material, a smectic ferroelectric liquid crystal and anti-ferroelectric liquid crystal and the like are developed. However, there are many problems which should be solved such as a problem of image sticking caused by effect of spontaneous polarization of the liquid crystal, a problem that orientation of the liquid crystal is easy to be destroyed by pressure, and the like.

On the other hand, for the development of the method increasing the response speed of the liquid crystal by improving the driving method of the liquid crystal display using the conventional liquid crystal material, there is a method that a gray-scale level added a predetermined gray-scale level to a writing gray-scale level is written in the liquid crystal display, when the image which is displayed in the liquid crystal display is changed (refer to 2001 SID International Symposium Digest of Technical Papers/Volume XXXII/ISSN-0001-966X P.488). An outline of operation of the method will be described below.

The response characteristics between the gray-scale levels of the liquid crystal display are previously measured, and the gray-scale level reached after one frame period (generally after 16.7 ms) is obtained. From this result, the writing gray-scale level required for changing a certain gray-scale level to another gray-scale level after one frame period is obtained, and stored as two-dimensional array data. That is to say, in the case of the liquid crystal display with the 256-level gray-scale level, in order to store data between all the gray-scale levels, the 256×256 array data is required. From which gray-scale level to which gray-scale level is examined for every sub-pixel of R, G, and B in each pixel in image information inputted to the liquid crystal display, and the writing gray-scale level for completing the response after one frame period is determined as referring to the array data. Namely, in the case that the image information changes from $L_0$ to $L_1$, $L_1$-level gray-scale is not written in the liquid crystal display, but $L_1'$-level gray-scale which can reach the $L_1$-level gray-scale after one frame period is written in the liquid crystal display, referring to the array data. By adopting this method, any liquid crystal display, in which the response from all the gray-scale levels to 0-level gray-scale and from all the gray-scale levels to 255-level gray-scale (in case of the liquid crystal display with the 256-level gray-scale) is completed within one frame period, can complete the response between almost all the gray-scale levels within one frame period.

FIG. 14 shows a concrete system configuration realizing the driving method of the above-described related art. Input image information and the image information delayed for one frame period by a frame memory part 32 are inputted to a gate array part 36. In the gate array part 36, on the basis of the input image information and the image information delayed for one frame period, address information indicating which data should be referred in an array data holding part 34 storing the above-described array data is outputted to the array data holding part 34. The array data holding part 34 outputs the stored array data to the gate array 36 on the basis of the inputted address information. The gate array part 36 outputs the inputted array data as the emphasized image information to a liquid crystal display 38, and the emphasized image is displayed on the liquid crystal display 38.

In the above-described method, there is no problem in the case that the input image information is image information of three primary colors, however, in the case that the input image information is the image information including luminance information and color-difference information, processing becomes complicated or it is necessary to drastically increase the number of array data. In the case that the input image information is the image information including the luminance information and the color-difference information, in the above-described method, in order to obtain the writing gray-scale level of each pixel, it is necessary that the input image information is transformed once into the image information of three primary colors and then a change in the gray-scale level for each sub-pixel is examined. Since the transformation processing from the luminance information and the color-difference information into the image information of three primary colors is relatively high burden, it is difficult for software to perform it in real-time. In the case that the luminance information and the color-difference information are used directly, the array data according to combination of the luminance information and the color-difference information is required, for example, in the case that the input image information includes one of the luminance information and two of the color-difference information, the two-dimensional array data of $256^3 \times 256^3$ is required. With increasing array data, the memory holding the array data requires to be increased, so that a problem of cost occurs. Moreover, when the method referring to the array data is processed with the software, the array data is held in a main memory and the like of the personal computer. However, for the above-described method such as referring the array data, it is difficult that the input image information is displayed in real-time, because random access to the main memory is the processing of the large burden.

BRIEF SUMMARY OF THE INVENTION

A liquid crystal displaying method according to one aspect of the present invention includes: multiplying a difference value of a luminance information and a difference value of a color-difference information each by an emphasis coefficient $\alpha$ ($\alpha$ is a positive real number), the difference value of the luminance information being the luminance information of the input image information having the luminance information and the color-difference information subtracted from the luminance information in which the input image information has been delayed for one frame period, the difference value of the color-difference information being the color-difference information of the input image information subtracted from the color-difference information in which the input image information has been delayed for one frame period; adding the luminance information in which the input image information has been delayed for one frame period and the color-difference information in which the input image information has been delayed for one frame period to the difference value of the luminance information multiplied by the emphasis coefficient $\alpha$ and the difference value of the color-difference information multiplied by the emphasis coefficient $\alpha$, respectively, to obtain emphasized image information; and displaying the emphasized image information on a liquid crystal display apparatus.

DETAILED DESCRIPTION OF THE INVENTION

Embodiments of the present invention will be described below referring to the accompanying drawings.

(First Embodiment)

Figure 1:
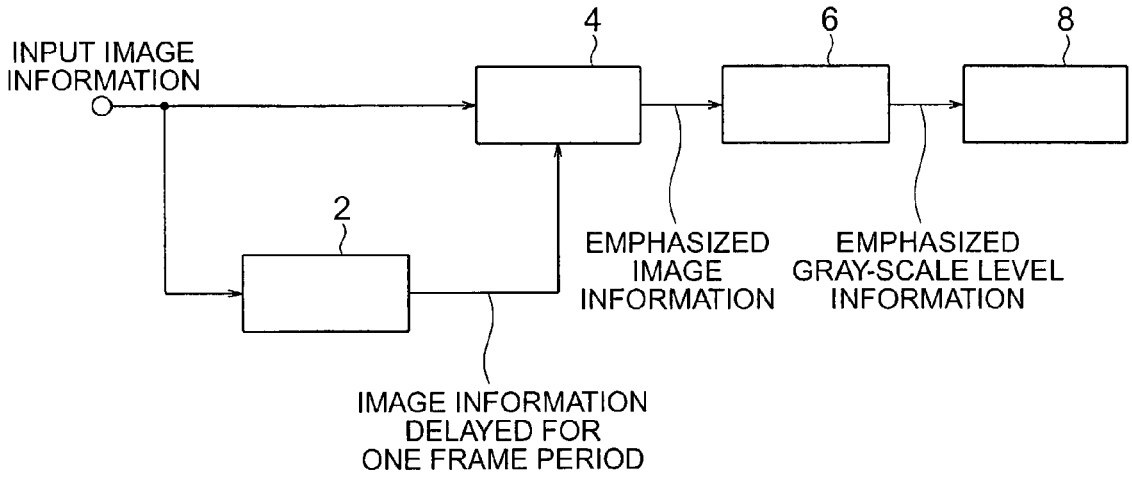
FIG. 1 shows a configuration of an implementation apparatus implementing a liquid crystal displaying method according to a first embodiment of the present invention.

FIG. 1 shows a configuration of an implementation apparatus implementing the liquid crystal displaying method according to a first embodiment of the present invention. The implementation apparatus implementing the liquid crystal displaying method according to the first embodiment includes a frame memory part 2 capable of holding input image information of one frame period, an emphasis coefficient multiplying part 4, and a gray-scale level information conversion part 6, and a liquid crystal display 8.

A concrete operation of the liquid crystal displaying method according to the first embodiment will be described below. An input image information including the luminance information and the color-difference information is inputted to the frame memory part 2 and the emphasis coefficient multiplying part 4. Though any image information including the luminance information and the color-difference information is applicable to the input image information, in the embodiment, decoded result of MPEG-2 (Moving Picture Experts Group 2) video data including one of luminance information (Y) and a pair of two of color-difference information (U,V) is used as the input image information.

In the decoded result of MPEG-2 video data, image information of one pixel includes one of the luminance information and the pair of color-difference information. However, the color-difference information is put together between adjacent pixels and transmitted. For example, the color-difference information of four pixels is put together. That is to say, the resolution (the number of pixels) of the chrominance becomes half for the luminance information in a vertical direction and horizontal direction of a screen respectively. Compared with human's spatial frequency characteristics for the color and for the brightness, because sensitivity reduction of the spatial frequency characteristics for the color is larger than that of the spatial frequency characteristics for the brightness in a high frequency range, the resolution of the color information can be reduced as described above, consequently, information quantity to be transmitted can be reduced. However, in order to simplify the description, it is assumed that, in the embodiment, one pixel including three sub-pixels R, G, and B is transmitted by one of the luminance information (Y) and two of the color-difference information (U,V).

The emphasis coefficient multiplying part 4 calculates the emphasized image information from the input image information and the image information delayed for one frame period by using the following equation (1).

$$\begin{bmatrix} Y_\alpha \\ U_\alpha \\ V_\alpha \end{bmatrix} = \alpha \begin{bmatrix} Y_1 - Y_0 \\ U_1 - U_0 \\ V_1 - V_0 \end{bmatrix} + \begin{bmatrix} Y_0 \\ U_0 \\ V_0 \end{bmatrix} \quad (1)$$

$(Y_0,U_0,V_0)$ indicates the image information delayed for one frame period, $(Y_1,U_1,V_1)$ indicates the input image information, $(Y_\alpha,U_\alpha,V_\alpha)$ indicates the emphasized image information, and a indicates an emphasis coefficient respectively. The emphasis coefficient $\alpha$ is a value determined by the response speed of the liquid crystal display 8, and derived from the following method.

Figure 2B:
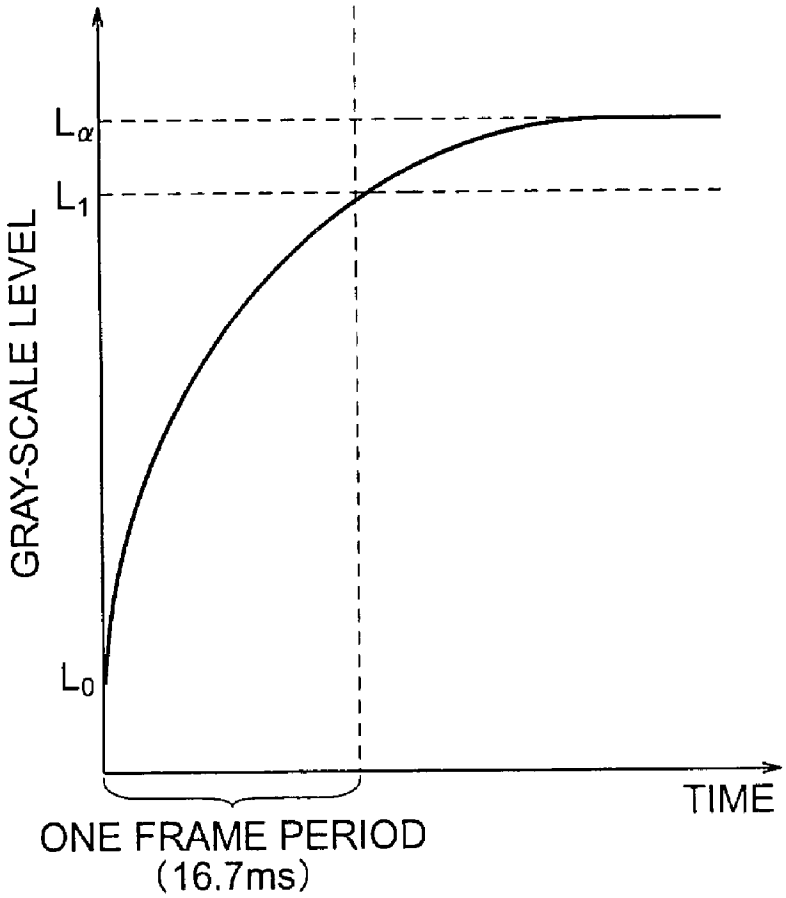
FIG. 2A and FIG. 2B show response waveforms of a liquid crystal display according to the first embodiment of the present invention.
Figure 2A:
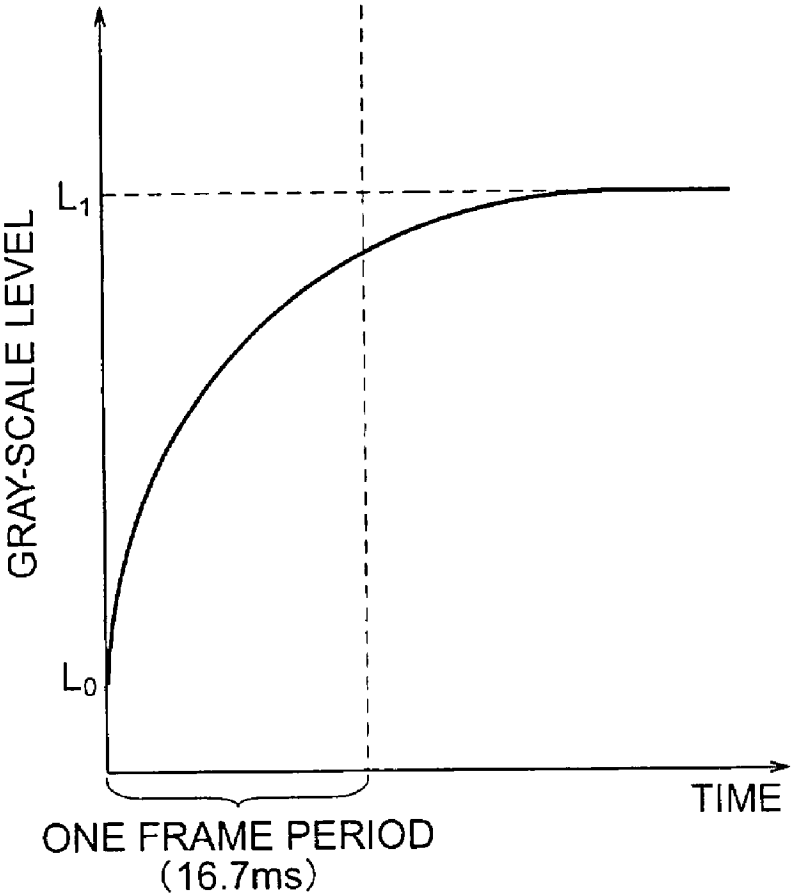

FIG. 2A and FIG. 2B show response waveforms of the liquid crystal display 8, when an $L_1$-level gray-scale (writing gray-scale level) is written in a pixel in the liquid crystal display 8 with $L_0$-level gray-scale (initial gray-scale level). When the refresh rate of the liquid crystal display 8 is set to 60 Hz, in order to that the moving picture is displayed without residual image in the liquid crystal display 8, it is necessary to reach $L_1$-level gray-scale from $L_0$-level gray-scale within 16.7 ms. However, generally the response speed between intermediate gray-scale levels of the liquid crystal display is too late, hence, in the case that $L_0$ and $L_1$ are the intermediate gray-scale level, the response of the liquid crystal display is not completed within 16.7 ms, as shown in FIG. 2A. Therefore, as shown in FIG. 2B, the emphasized gray-scale level $L_\alpha$ is determined so as to reach $L_1$-level gray-scale from $L_0$-level gray-scale within 16.7 ms. By performing the above-described operation through the responses between all gray-scale levels, it is found which gray-scale level should be written to be reached the desired gray-scale level after one frame period, when the liquid crystal display changes from one of gray-scale level to other gray-scale level. However, since $L_\alpha$ is in the range of a value from zero to the maximum gray-scale level (for example, $L_\alpha$=255 in case of liquid crystal display with the 256-level gray-scale) of the liquid crystal display, there is a case in which $L_0$ can not reach $L_1$ even if $L_\alpha$ is written. In such case, it is assumed that $L_\alpha$ is the maximum gray-scale level of the liquid crystal display (for example, $L_\alpha$=255 in case of liquid crystal display with the 256-level gray-scale) or the minimum gray-scale level ($L_\alpha$=0). That is to say, when $L_0$ is 100 and $L_1$ is 220, in the case that the response is possible only up to 200 even if 255 is written as the $L_\alpha$, $L_\alpha$ is set to 255. On the contrary, when $L_0$ is 200 and $L_1$ is 30, in the case that the response is possible only up to 50 even if zero is written as the $L_\alpha$, $L_\alpha$ is set to zero.

Figure 3:
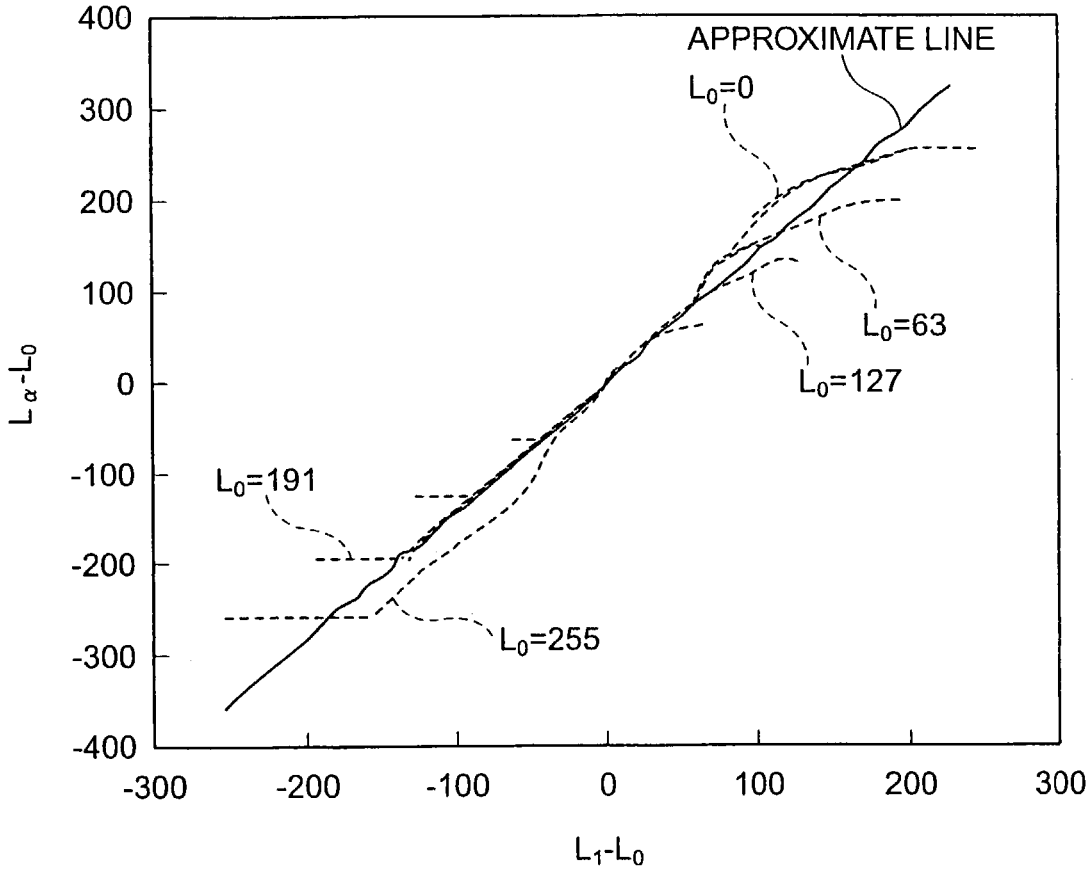
FIG. 3 shows a relationship among $L_0$, $L_1$, and $L_\alpha$ in the first embodiment.

FIG. 3 shows a relationship among $L_0$, $L_1$, and $L_\alpha$. In FIG. 3, the horizontal axis indicates $L_1-L_0$ and the vertical axis indicates $L_\alpha-L_0$. FIG. 3 shows the case that $L_0$ is 0, 63, 127, 191, and 255. It is found from FIG. 3 that the relationship between $L_1-L_0$ and $L_1-L_0$ can be approximated as a straight line. pointing FIG. 3, a slope of the approximate line is about 1.4. The approximate line can be calculated from the relationship between $L_\alpha-L_0$ and $L_1-L_0$ by using the least mean square error method or the like. In this case, the slope of the approximate line is set to the emphasis coefficient $\alpha$. When the gray-scale level information of three sub-pixels for R, G, and B changes from $(R_0,G_0,B_0)$ to $(R_1,G_1,B_1)$, the emphasized gray-scale level $(R_\alpha,G_\alpha,B_\alpha)$ required to reach $(R_1,G_1,B_1)$ after one frame period (after 16.7 ms) can be obtained from the relationship as equation (2).

$$\begin{bmatrix} R_\alpha - R_0 \\ G_\alpha - G_0 \\ B_\alpha - B_\alpha \end{bmatrix} = \begin{bmatrix} \alpha & 0 & 0 \\ 0 & \alpha & 0 \\ 0 & 0 & \alpha \end{bmatrix} \begin{bmatrix} R_1 - R_0 \\ G_1 - G_0 \\ B_1 - B_0 \end{bmatrix} \quad (2)$$

The image information (Y,U,V) including one of the luminance information and two of the color-difference information can be obtained by matrix-transforming the gray-scale level information (R,G,B) of one pixel including three sub-pixels for R, G, and B. The matrix transformation is shown in the following equation (3).

$$\begin{bmatrix} Y \\ U \\ V \end{bmatrix} = \begin{bmatrix} 0.257 & 0.504 & 0.098 \\ -0.148 & -0.291 & 0.439 \\ 0.439 & -0.368 & -0.071 \end{bmatrix} \begin{bmatrix} R \\ G \\ B \end{bmatrix} \quad (3)$$

Elements (coefficient) of the matrix transformation in equation (3) is an example, other matrix coefficients can be also applicable. In the same way, the transformation from (Y,U,V) to (R,G,B) can be expressed by the matrix transformation, and it is expressed by the follow equatoin (4).

$$\begin{bmatrix} R \\ G \\ B \end{bmatrix} = \begin{bmatrix} 0.257 & 0.504 & 0.098 \\ -0.148 & -0.291 & 0.439 \\ 0.439 & -0.368 & -0.071 \end{bmatrix}^{-1} \begin{bmatrix} Y \\ U \\ V \end{bmatrix} \quad (4)$$

By using equation (2), equation (3), and equation (4), in case that the image information changes from $(Y_0,U_0,V_0)$ to $(Y_1,U_1,V_1)$, the emphasized image information $(Y_\alpha,U_\alpha,V_\alpha)$ can be obtained as follows.

$$\begin{bmatrix} Y_\alpha - Y_0 \\ U_\alpha - U_0 \\ V_\alpha - V_0 \end{bmatrix} = \begin{bmatrix} 0.257 & 0.504 & 0.098 \\ -0.148 & -0.291 & 0.439 \\ 0.439 & -0.368 & -0.071 \end{bmatrix} \begin{bmatrix} \alpha & 0 & 0 \\ 0 & \alpha & 0 \\ 0 & 0 & \alpha \end{bmatrix} \begin{bmatrix} 0.257 & 0.504 & 0.098 \\ -0.148 & -0.291 & 0.439 \\ 0.439 & -0.368 & -0.071 \end{bmatrix}^{-1} \times \begin{bmatrix} Y_1 - Y_0 \\ U_1 - U_0 \\ V_1 - V_0 \end{bmatrix} \quad (5)$$

Here, since a dot product of the matrix of the transformation from (R,G,B) to (Y,U,V) and the matrix of the transformation from (Y,U,V) to (R,G,B) is an identity matrix, equation (1) is finally obtained.

The emphasized image information $(Y_\alpha,U_\alpha,V_\alpha)$ obtained by equation (1) is inputted to the gray-scale level information conversion part 6 to be transformed to the emphasized gray-scale level information $(R_W,G_W,B_W)$. The emphasized gray-scale level information in one frame period is obtained by performing the above-described operation for each pixel of the image displayed in one frame period. Then, the emphasized gray-scale level information in one frame period is inputted into the liquid crystal display 8, and the emphasized image is displayed.

When $(Y_\alpha,U_\alpha,V_\alpha)$ is obtained from equation (1), there is a case in which $(Y_\alpha,U_\alpha,V_\alpha)$ becomes an abnormal value, that is to say, when $(R_\alpha,G_\alpha,B_\alpha)$ is obtained, there is a case in which any one of $(R_\alpha,G_\alpha,B_\alpha)$ is less than zero or exceeds the maximum gray-scale level value of the liquid crystal display 8. However, the abnormal value may be rounded within the range of a normal value, or set predetermined range of (Y,U,V) of a possible value in the emphasis coefficient multiplying part 4 or the gray-scale level information conversion part 6.

With reference to a calculating method of the emphasis coefficient $\alpha$, as described above, it may be obtained from the whole of the relationship between $L_1-L_0$ and $L_1-L_0$ by using the least mean square error method and the like, however, except the case in which $L_0$ does not reach $L_1$ even if $L_\alpha$ is written (namely, case in which $L_0$ does not reach $L_1$ even if $L_\alpha$ is 255 or zero), the emphasis coefficient $\alpha$ may be obtained by the least mean square error method and the like. This is because, in the above-described case, $L_\alpha$ becomes more than 256 or less than zero when $L_\alpha$ is obtained from the approximate line and the abnormal value of $L_\alpha$ is transformed to the normal value by software or hardware.

Figure 4:
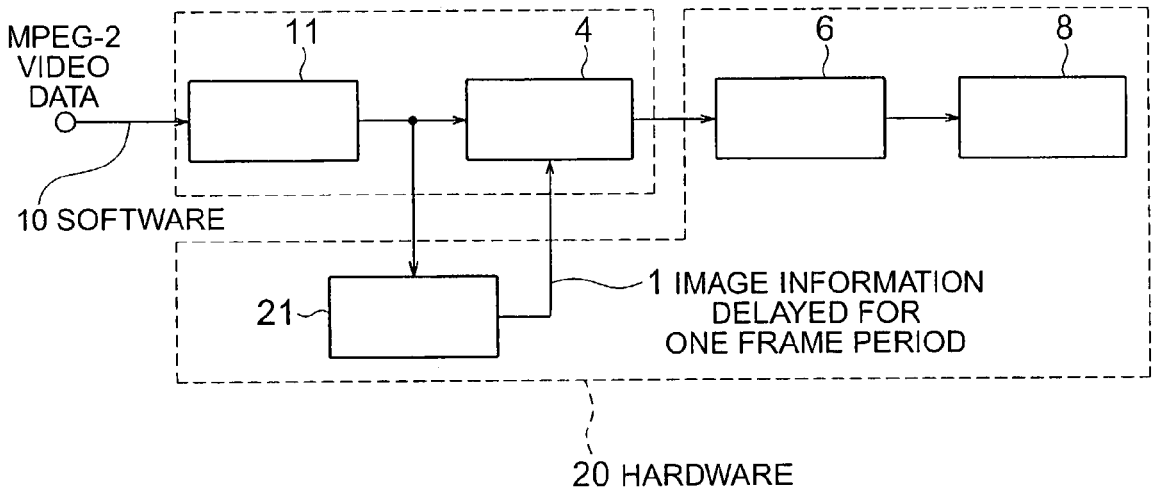
FIG. 4 shows a concrete configuration implementing the liquid crystal displaying method according to the first embodiment.

FIG. 4 shows a concrete system configuration of the implementation apparatus implementing the liquid crystal displaying method according to the first embodiment. The implementation apparatus shown in FIG. 4 has the configuration in which the emphasis coefficient multiplying part 4 is added to an MPEG-2 video software decoder of a notebook computer equipped with the liquid crystal display. That is to say, the implementation apparatus includes the MPEG-2 video decoder part 11 decoding MPEG-2 video data, the emphasis coefficient multiplying part 4, a memory part 21, the gray-scale level information conversion part 6 and the liquid crystal display 8. The MPEG-2 video decoder part 11 and the emphasis coefficient multiplying part 4 include software 10, and the memory part 21, the gray-scale level information conversion part 6, and the liquid crystal display 8 include hardware 20.

The operation of the apparatus shown in FIG. 4 will be described. The MPEG-2 video data is decoded into one of the luminance information and two of the color-difference information by the MPEG-2 video decoder part 11, and inputted to the memory part 21 and the emphasis coefficient multiplying part 4. In the memory part 21, in the same way as the frame memory part 2 shown in FIG. 1, the image information delayed for one frame period is outputted to the emphasis coefficient multiplying part 4. Any components such as main memory mounted on the notebook computer or video memory which is a component of a video processing part, which can hold the image information, may be used as the memory part 21.

Figure 5:
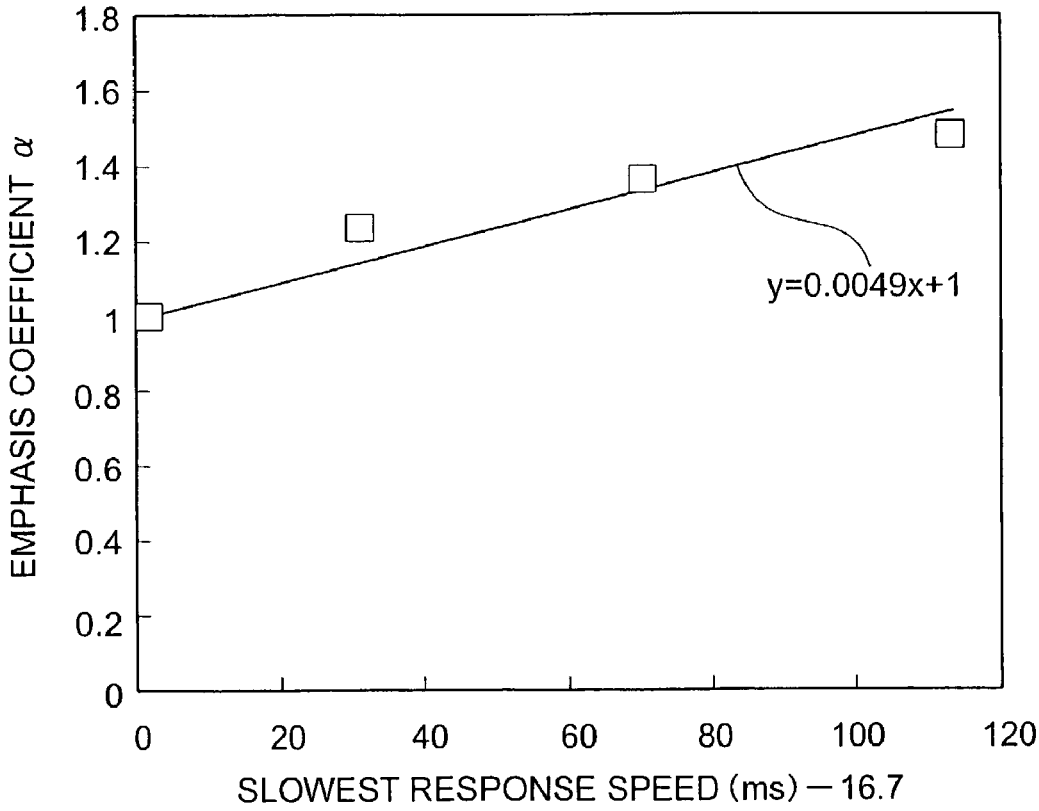
FIG. 5 is a view explaining a value of an emphasis coefficient $\alpha$ which is determined on the basis of response characteristics of the liquid crystal display is in the range from about 1 to about 2.

The emphasis coefficient multiplying part 4 performs the processing shown in equation (1) on the basis of the inputted image information and the image information delayed for one frame period by the memory part 21, and outputs one of emphasized luminance information and two of emphasized color-difference information as the emphasized image information. A value determined previously on the basis of the response characteristics of the liquid crystal display is used as the emphasis coefficient $\alpha$, and the value is in the range about 1 to about 2. This range is obtained from the relationship in FIG. 5. In FIG. 5, the horizontal axis indicates the slowest response speed of the liquid crystal display −16.7 ms (one frame period) and the vertical axis indicates the emphasis coefficient $\alpha$. From FIG. 5, the approximate line can be expressed as the following equation (6), when the emphasis coefficient $\alpha$ is 1 in case that the horizontal axis is zero.

$$\alpha=0.0049x(\text{the slowest response speed [ms]}-16.7)+1 \quad (6)$$

The reason why the emphasis coefficient is 1 when the horizontal axis is zero is that it is not necessary to perform the emphasis processing when the horizontal axis is zero, namely the slowest response speed is 16.7 ms. Because the slowest response speed of the current liquid crystal display is largely not more than 200 ms, the emphasis coefficient $\alpha$ is about 2 at most from the above-described relational equation (6).

One of the emphasized luminance information and two of the emphasized color-difference information are converted into three of the gray-scale level information of R, G, and B by the gray-scale level information conversion part 6 and outputted to the liquid crystal display 8, and then the emphasized image is displayed in the liquid crystal display.

In the processing performed in the emphasis coefficient multiplying part 4, only multiplication of one time, subtraction of one time, and addition of one time are performed for each of the image information of one pixel including one of luminance information and two of color-difference information, and above-described processing is not so large burden for the emphasis coefficient multiplying part 4. Moreover, because the operation for each of the luminance information and the color-difference information in equation (1) is independent, each operation can be simultaneously processed by CPU (Central Processing Unit) in the notebook computer. Therefore, the plurality of pixels can be simultaneously processed by the CPU, so that the moving picture data can be sufficiently processed in real-time.

Though the configuration example formed by the software was described in the embodiment, part of the processing or the whole processing may be formed by the hardware.

As described above, in the liquid crystal displaying method of the embodiment, the high-quality moving picture can be displayed on the liquid crystal display by the processing which is so easy that the moving picture data can be processed in real-time by the software.

(Second Embodiment)

The liquid crystal displaying method according to a second embodiment of the present invention will be described below referring to FIG. 6. The liquid crystal displaying method of the second embodiment is basically the same as the first embodiment, however, it is characterized that, when all of the absolute difference value of the luminance information and the color-difference information of certain pixel between the temporary adjacent frames in the input image information are lower than a predetermined value, the emphasis coefficient $\alpha$ of its pixel is set to a value of not more than 1.

Figure 6:
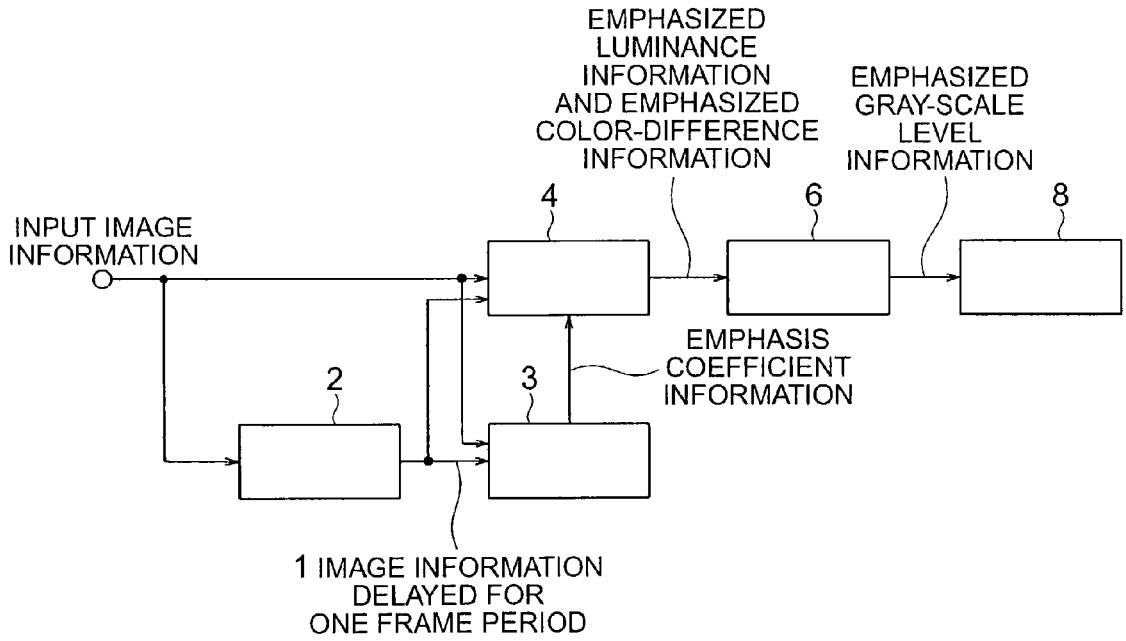
FIG. 6 shows a configuration of an implementation apparatus implementing a liquid crystal displaying method according to a second embodiment of the present invention.

FIG. 6 shows the configuration of the implementation apparatus implementing the liquid crystal displaying method according to the embodiment. The implementation apparatus implementing the liquid crystal displaying method of the embodiment basically has the configuration in which an emphasis coefficient changing part 3 is added to the implementation apparatus implementing the liquid crystal displaying method of the first embodiment. The emphasis coefficient changing part 3 makes decision whether all of the absolute difference value of the luminance information and color-difference information of each pixel are lower than the predetermined value or not, and changes the emphasis coefficient $\alpha$ for the pixel to the value of not more than 1 when all of the absolute difference values are lower than the predetermined value.

The operation of the liquid crystal displaying method of the embodiment will be described below. The image information including the inputted luminance information (Y) and the inputted color-difference information (U,V) is inputted to the frame memory part 2 and the emphasis coefficient changing part 3. The operation of the frame memory part 2 is the same as that of the first embodiment, the image information delayed for one frame period is outputted.

The emphasis coefficient changing part 3 calculates the absolute difference value between the adjacent frames of the luminance information and the color-difference information for inputted each pixel, and makes the decision whether the calculated absolute difference value is lower than the predetermined value $L_{th}$ or not. When the emphasis coefficient changing part 3 has made the decision that all of the absolute difference value of the luminance information and the color-difference information of a certain pixel are lower than the predetermined value $L_{th}$, the emphasis coefficient changing part 3 changes the emphasis coefficient $\alpha$ for its pixel to the value of not more than 1. On the other hand, when the emphasis coefficient changing part 3 has made the decision that at least one of the absolute difference values is more than the predetermined value $L_{th}$, the emphasis coefficient changing part 3 outputs the emphasis coefficient $\alpha$ obtained by the same method as that of the first embodiment.

The emphasis coefficient $\alpha$ and the luminance information and the color-difference information of the input image information, which are outputted from the emphasis coefficient changing part 3, are inputted to the emphasis coefficient multiplying part 4, the emphasis coefficient multiplying part 4 performs the calculation shown in equation (1) by using the emphasis coefficient $\alpha$ determined by the emphasis coefficient changing part 3 and outputs the emphasized luminance image information and the color-difference information. In the same way as the first embodiment, the emphasized image information outputted from the emphasis coefficient changing part 3 is inputted to the gray-scale level information conversion part 6, converted into the emphasis gray-scale level information, and inputted to the liquid crystal display 8, and then the emphasized image is displayed in the liquid crystal display.

By performing the above-described processing, quantity of the emphasis can be reduced when a change in the image information of the pixel is small. That is to say, for example, for the case in which there is a large quantity of the noise in the input image information, when the emphasis processing between all the gray-scale levels is performed, quantity of the noise is also emphasized and the noise in the image is easily recognized, which results in degradation of the image. Because the noise component is not so large for signal amplitude, it is possible not to amplify the noise component by the above-described processing, so that the degradation of the image caused by the noise can be prevented. It is desirable that the predetermined value $L_{th}$ is determined by a quantity (amplitude) of the noise of the input image information, however, usually it may be set to a value from about 5 to about 10. The emphasis coefficient $\alpha$ is usually set to 1 (namely, the emphasis processing is not performed at all), when the absolute difference value of the image information is lower than the predetermined value $L_{th}$. However, in the case of the input image information having the large noise, the noise can be reduced by setting the emphasis coefficient $\alpha$ to the value of not more than 1.

In the liquid crystal displaying method according to the embodiment, compared with the first embodiment, logical operation is increased by only three times for one pixel and usually the processing for the logical operation is performed relatively fast, so that the moving picture can be sufficiently processed in real-time by the software.

As described above, in the liquid crystal displaying method of the embodiment, similarly to the first embodiment, the high-quality moving picture can be displayed on the liquid crystal display by the processing which is so easy that the moving picture data can be processed in real-time by the software.

(Third Embodiment)

The liquid crystal displaying method according to a third embodiment of the present invention will be described below referring to FIG. 7. The liquid crystal displaying method of the third embodiment is basically the same as the second embodiment, however, it is characterized that when the absolute difference value of the luminance information of certain pixel between the temporary adjacent frames in the input image information are lower than a predetermined value, the emphasis coefficient $\alpha$ of its pixel is set to a value of not more than 1.

Figure 7:
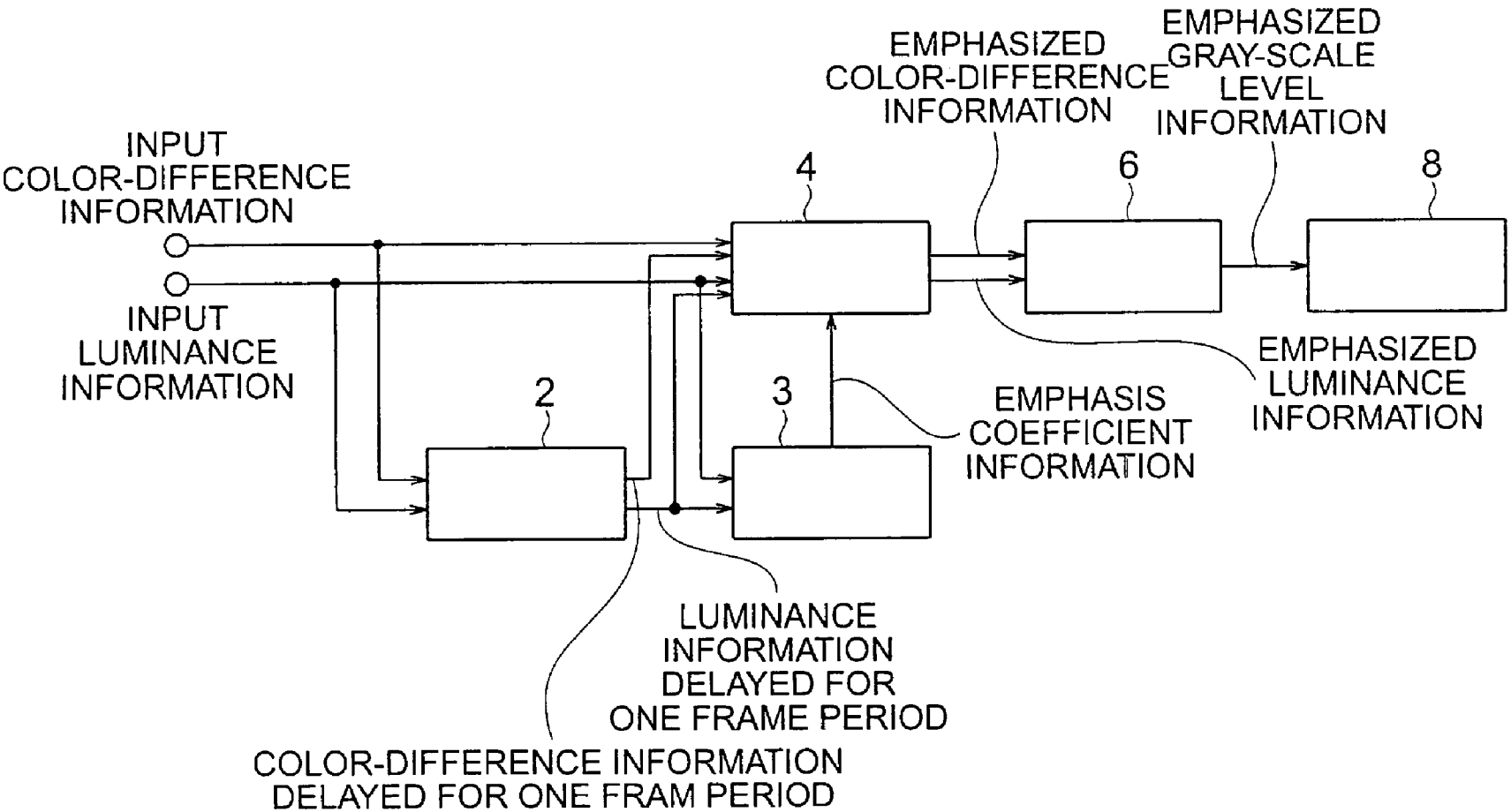
FIG. 7 shows a configuration of an implementation apparatus implementing a liquid crystal displaying method according to a third embodiment of the present invention.

FIG. 7 shows the configuration of the implementation apparatus implementing the liquid crystal displaying method according to the embodiment. The implementation apparatus implementing the liquid crystal displaying method of the third embodiment basically has the same configuration as that of the implementation apparatus implementing the second embodiment. In the emphasis coefficient changing part 3 according to the second embodiment, when all of the absolute difference value of the luminance information and the color-difference information of certain pixel between the temporary adjacent frames are lower than the predetermined value $L_{th}$, the emphasis coefficient changing part 3 changes the emphasis coefficient $\alpha$ of its pixel to the value of not more than 1. However, in the emphasis coefficient changing part 3 according to the third embodiment, the absolute difference value of the luminance information is only used as reference of the decision and the absolute difference value of the color-difference information is not referred. This is because particularly easy visibility of the noise of the input image information is the noise of the brightness, therefore, the emphasis coefficient $\alpha$ is changed referring to only the absolute difference value of the luminance information.

According to the method, the logical operation is performed only once for one pixel, so that the processing can be reduced, compared with the second embodiment.

As described above, in the liquid crystal displaying method of the embodiment, similarly to the first embodiment, the high-quality moving picture can be displayed on the liquid crystal display by the processing which is so easy that the moving picture data can be processed in real-time by the software.

(Fourth Embodiment)

The liquid crystal displaying method according to a fourth embodiment of the present invention will be described below referring to FIG. 8. The implementation apparatus implementing the liquid crystal displaying method of the fourth embodiment, which is characterized by having an interface, by which a user can optionally set and change the emphasis coefficient $\alpha$ in the implementation apparatus according to the first embodiment.

Figure 8:
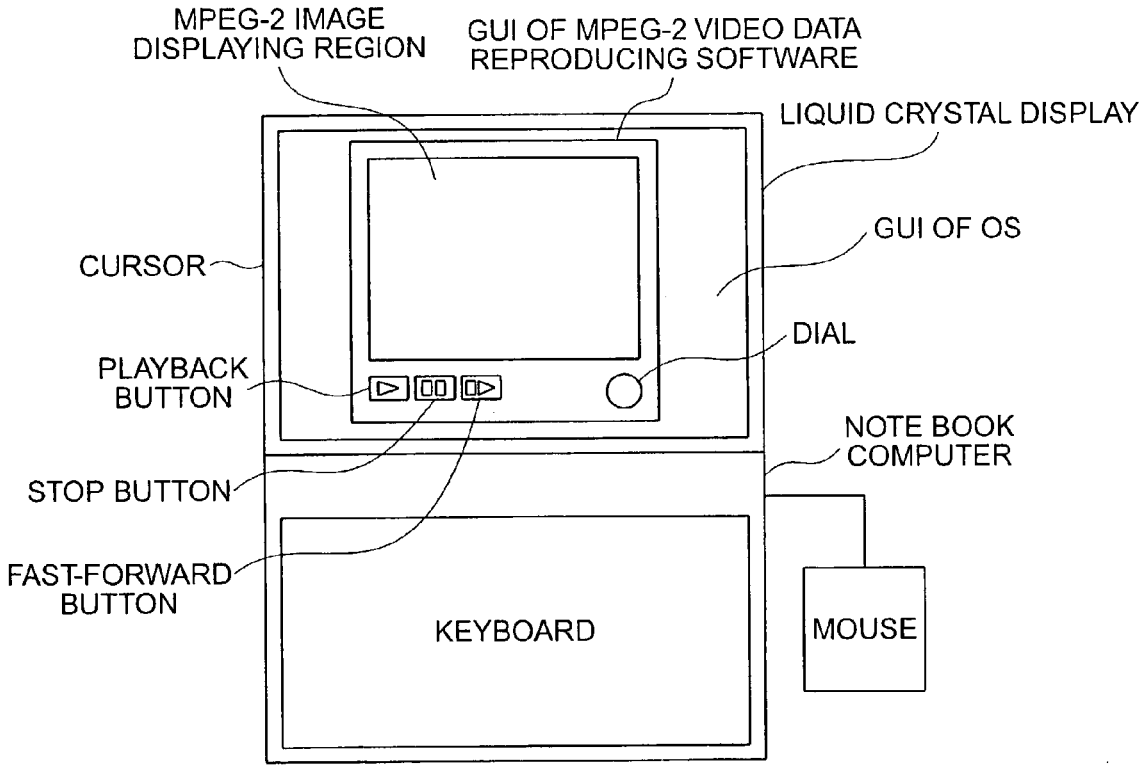
FIG. 8 shows GUI of MPEG-2 video reproducing software according to a fourth embodiment of the present invention.

FIG. 8 shows the interface of the MPEG-2 video data reproducing software of the notebook computer implementing the liquid crystal displaying method of the embodiment. Though the system of the MPEG-2 video data reproducing software is the same as that of the first embodiment shown in FIG. 4, the system of the embodiment has the configuration in which the user can change the emphasis coefficient $\alpha$ through the interface. The MPEG-2 video data reproducing software is executed on an OS (Operating System) of the notebook computer, and the reproducing software is formed to be executed on Windows 98 (Registered Trademark of Microsoft Corporation in the United States) in the embodiment. The OS and the MPEG-2 video data reproducing software are formed so that the user can operate them with a graphical user interface (GUI), for example, the user can operate a cursor on the OS with a pointing device such as a mouse to execute a given operation. For example, because buttons such as PLAYBACK, STOP, and FAST-FORWARD are displayed on the screen in the MPEG-2 video data reproducing software, the user operates the cursor on the OS with the pointing device and selects each button, so that the user can perform the processing such as reproducing, stop, and fast-forward for the image information of MPEG-2 video data.

Figure 9:
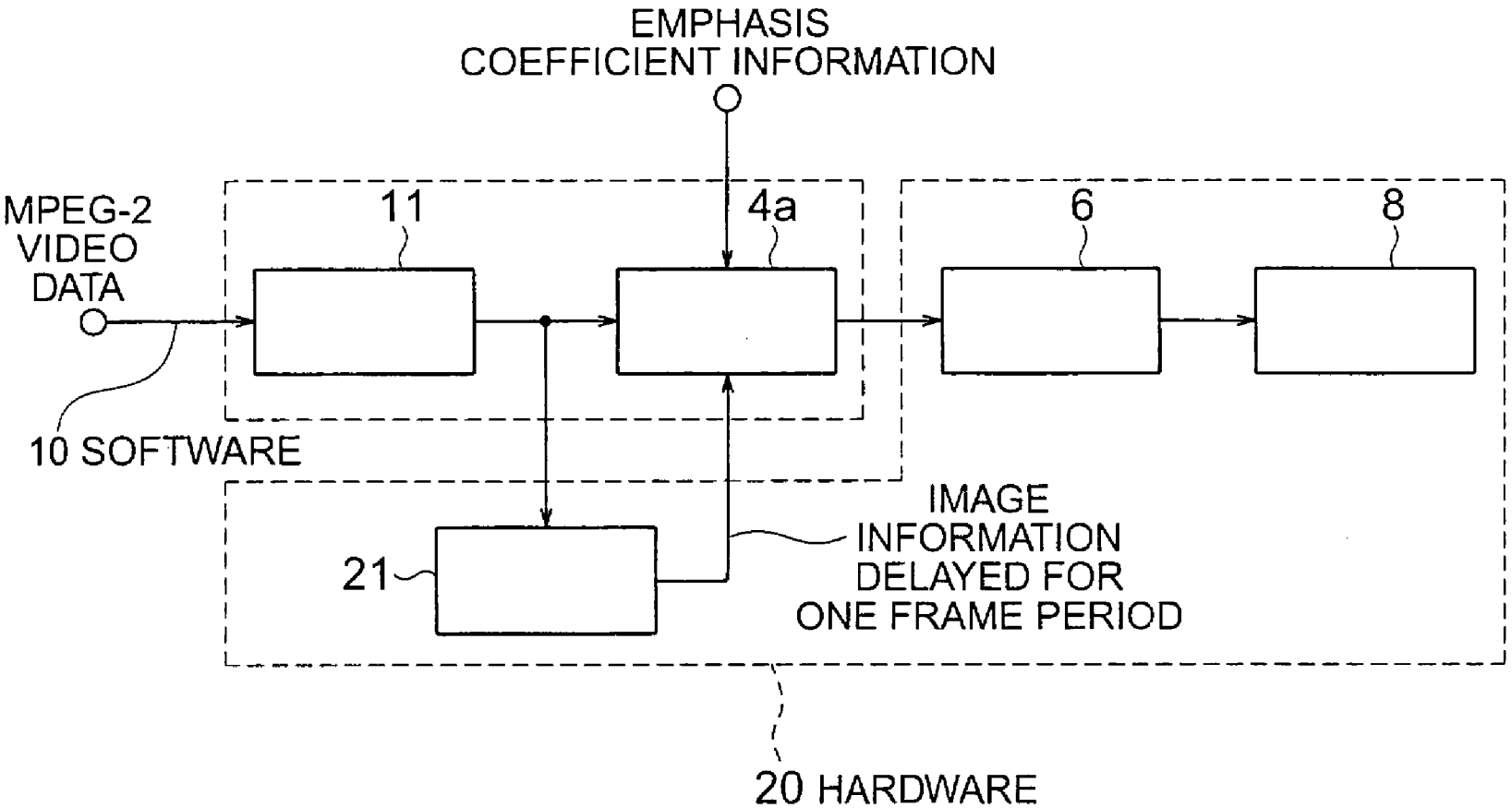
FIG. 9 shows a configuration of an implementation apparatus implementing a liquid crystal displaying method according to the fourth embodiment of the present invention.

The MPEG-2 video data in the embodiment is processed by the implementation apparatus shown in FIG. 9. The implementation apparatus shown in FIG. 9 has the configuration in which the emphasis coefficient multiplying part 4 is replaced by an emphasis coefficient multiplying part 4*a* in the first embodiment shown in FIG. 4. The emphasis coefficient multiplying part 4*a* has the configuration to which a function, which the user can optionally set and change the emphasis coefficient α, is added in the emphasis coefficient multiplying part 4. In the implementation apparatus shown in FIG. 9, when the emphasis coefficient α is set or changed by the user, the same processing as that of the implementation apparatus shown in FIG. 4 is performed by using the set or changed emphasis coefficient α. On the other hand, when the emphasis coefficient α is not set or not changed by the user, the same processing as that of the implementation apparatus shown in FIG. 4 is performed by using a value, which is previously determined on the basis of the response characteristics of the liquid crystal display mounted on the implementation apparatus, and then the image is displayed on an image displaying region of the MPEG-2 video data reproducing software.

The MPEG-2 video data reproducing software according to the embodiment has, for example, the dial-shaped GUI for changing the emphasis coefficient α, the emphasis coefficient can be changed in such a manner that the user uses the cursor to perform the rotating operate of the dial. The dial-shaped GUI is an example, the slider-shaped GUI is also usable, or there is also a method which directly inputs the emphasis coefficient in numerical value with a keyboard as the interface device provided in the notebook computer. The emphasis coefficient α, which is previously determined on the basis of the response speed of the liquid crystal display, can be adjusted by the embodiment, and the adjustment such as the sharper display can be performed in such a manner that the user changes the emphasis coefficient α into a larger value according to the user's preference.

Though the configuration example formed by the software is shown in the embodiment, part of the processing or the whole processing may be formed by the hardware. For example, in the case that the processing is formed by the hardware, the emphasis coefficient α may be adjusted by a knob and the like, which is formed by the hardware.

As described above, in the liquid crystal displaying method of the embodiment, the user can change the display quality of the moving picture according to the user's preference by the processing which is so easy to be performed in real-time with the software.

(Fifth Embodiment)

The liquid crystal displaying method according to a fifth embodiment of the present invention will be described below. The liquid crystal displaying method of the fifth embodiment is basically the same as the first embodiment, however, it is characterized that the display is performed by multiplying the emphasis coefficient α by an imaging correction coefficient β determined on the basis of the image information in which the input image information is imaged or not imaged.

Figure 10:
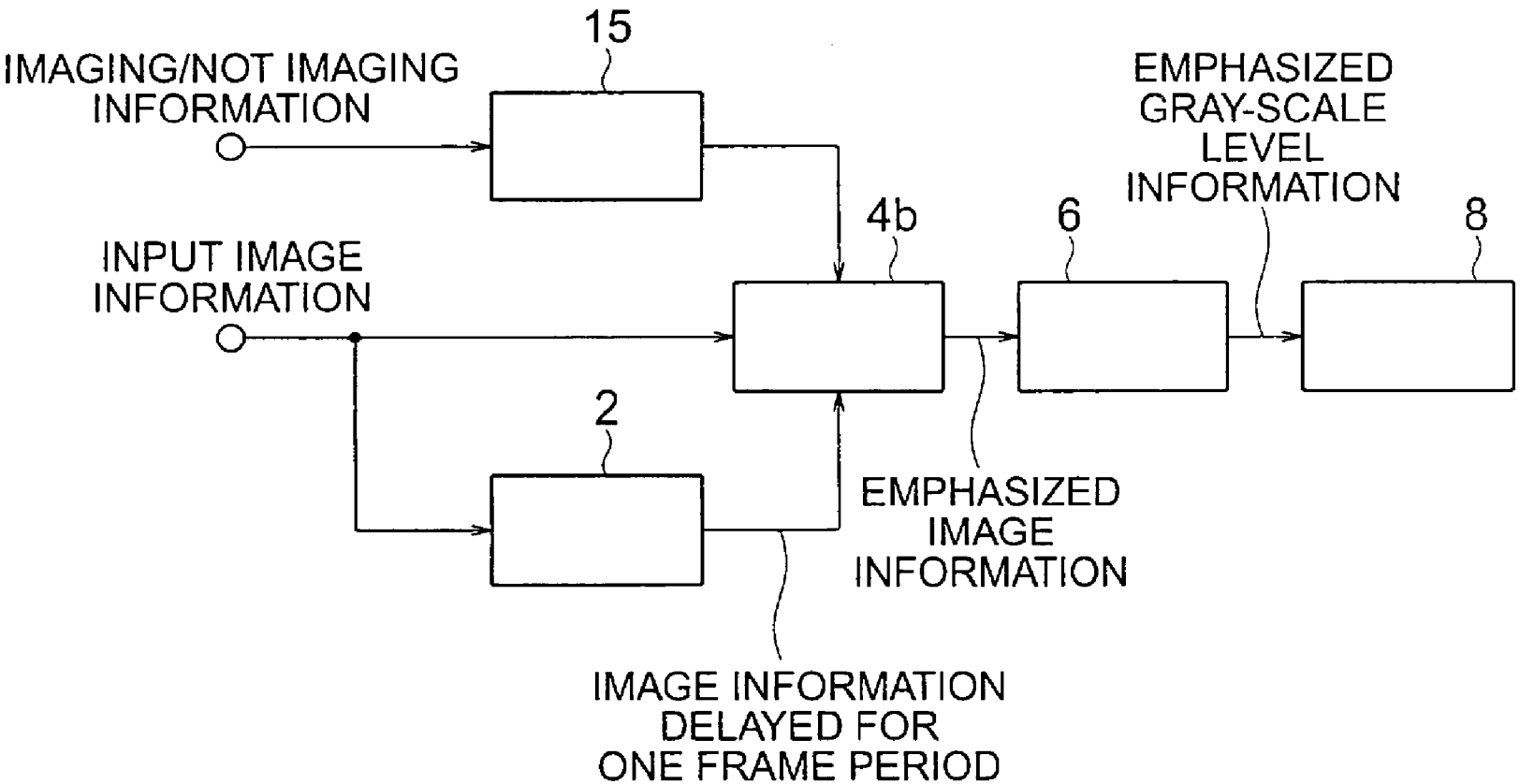
FIG. 10 shows a configuration of an implementation apparatus implementing a liquid crystal displaying method according to a fifth embodiment of the present invention.

FIG. 10 shows the configuration of the implementation apparatus implementing the liquid crystal displaying method according to the embodiment. The implementation apparatus implementing the liquid crystal displaying method of the embodiment basically has the configuration in which an imaging correction coefficient outputting part 15, which outputs the imaging correction coefficient β on the basis of imaging/not-imaging information showing whether the input image information is the image information in which the input image information is imaged or not imaged, is newly provided and the emphasis coefficient multiplying part 4 is replaced by an emphasis coefficient multiplying part 4*b* in the implementation apparatus according to the first embodiment shown in FIG. 1.

Figure 11:
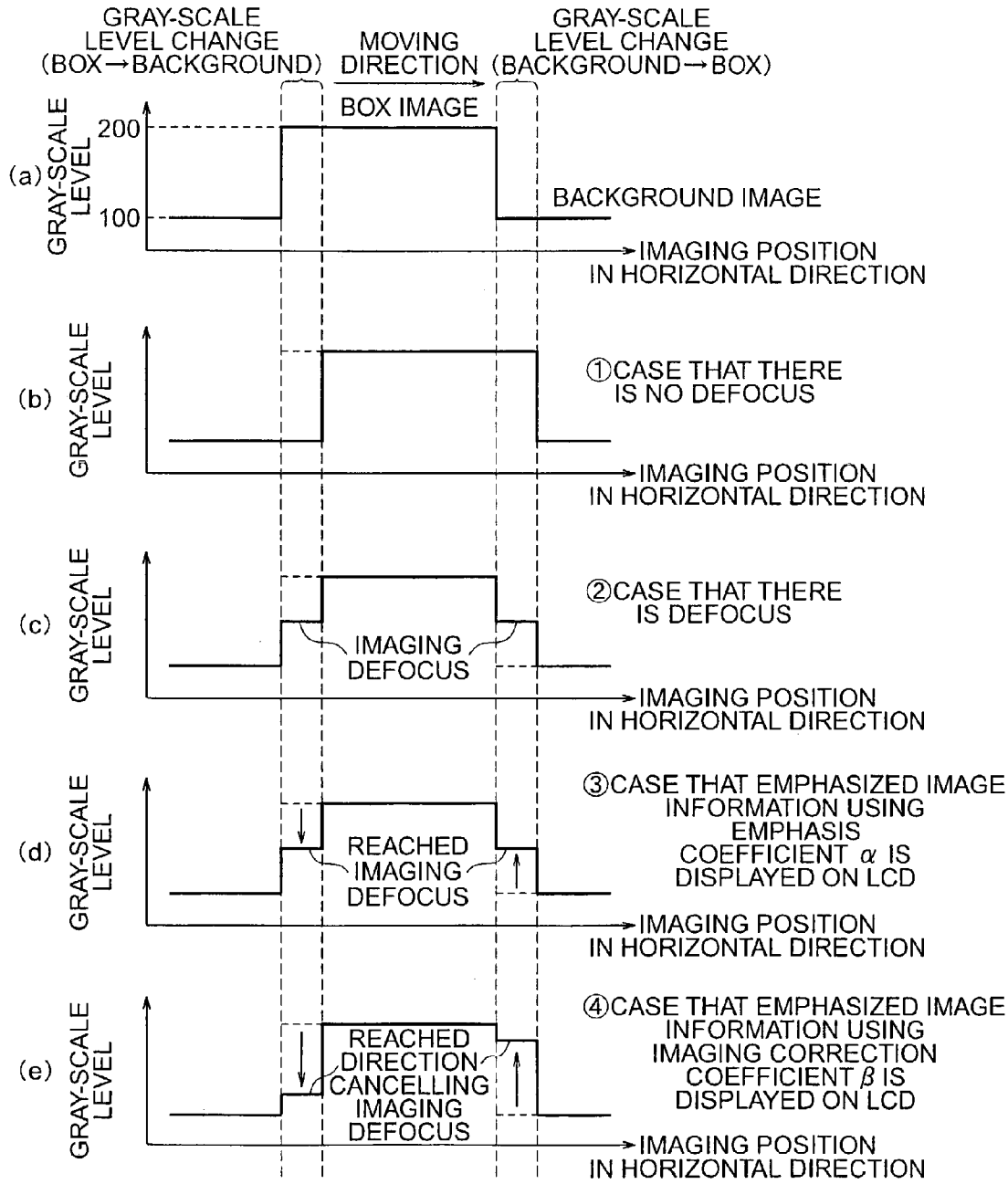
FIGS. 11(*a*) to 11(*e*) are a view explaining an effect of the liquid crystal displaying method according to the fifth embodiment.

In a personal computer, which has the liquid crystal display, such as the notebook computer, various kinds of image information are displayed on the liquid crystal display. Such kinds of image information are roughly divided into the image information in which the input image information is imaged (for example, a movie) and the image information in which the input image information is not imaged (for example, a game image and a CG image). Because the imaging usually records the subject for a certain period (generally one frame period), when the subject is moving, defocus occurs in an edge part according to motion of the subject. On the other hand, in the game image, the CG image, or the like, because one frame image is created by the computer, the above-described imaging defocus is not included. In the case that the image information including the imaging defocus is displayed on the liquid crystal display, even if the defocus of the moving picture caused by the response characteristics of the liquid crystal display can be improved by the emphasis coefficient a, the original image includes the imaging defocus, which causes the image quality of the moving picture to be degraded. For example, FIG. 11 shows a schematic diagram of the case that the moving picture in which a box image with the 200-level gray-scale scrolls horizontally on a background image with the 100-level gray-scale is displayed. In FIGS. 11(*a*) to 11(*e*), the vertical axis indicates the gray-scale level and the horizontal axis indicates a display position of the horizontal direction of the liquid crystal display. For the case that the box image displayed in FIG. 11(*a*) is scrolled across in the right direction, when the imaging defocus does not occur, ideally the box image is displayed after one frame, as shown in FIG. 11(*b*). However, when the imaging defocus is included, the imaging defocus in which the gray-scale level of the background image and the gray-scale level of the box image are averaged appears in the edge parts of the box image, as shown in FIG. 11(*c*). Even if the image is displayed for the image shown in FIG. 11(*c*), as shown in FIG. 11(*d*), the display image after one frame period includes the imaging defocus, and the image quality of the moving picture is degraded. Therefore, as shown in FIG. 11(*e*), compared with FIG. 11(*d*), the imaging defocus can be reduced in the display image after one frame period by displaying the image in which the emphasis processing is further performed. As a result, the image quality of the moving picture can be improved.

Next, a concrete example of the operation will be described. Similarly to the first embodiment, the input image information and the image information delayed for one frame period by the frame memory part are inputted to the emphasis coefficient multiplying part 4*b*. The imaging correction coefficient outputting part 15 makes the decision whether the input image information is imaged or not imaged on the basis of the inputted imaging/not-imaging information, and outputs the imaging correction coefficient β. Various values can be used as the imaging correction coefficient β according to the degree of the imaging defocus of the image which is imaged and the response characteristics of the liquid crystal display, and usually the value is in the range from 1 to 2. In the embodiment, β is set to 1.5 in the case that the input image information is the image information which is imaged, and β is set to 1 in the case that the input image information is the image information which is not-imaged. The imaging/not-imaging information can be obtained through various kinds of information. For example, when the input image information is the image recorded in DVD (Digital Versatile Disk), the imaging correction coefficient outputting part 15 makes the decision that the input image information is the image information is imaged like the movie, when the input image information is the game image, the imaging correction coefficient outputting part 15 makes the decision that the input image information is the image information which is not imaged. The outputted imaging correction coefficient β is inputted to the emphasis coefficient multiplying part 4*b*. In the emphasis coefficient multiplying part 4*b*, the calculation of equation (7) is performed by using the predetermined emphasis coefficient α and the inputted imaging correction coefficient β, and the emphasis image information is outputted.

$$\begin{bmatrix} Y_\alpha \\ U_\alpha \\ V_\alpha \end{bmatrix} = \alpha\beta \begin{bmatrix} Y_1 - Y_0 \\ U_1 - U_0 \\ V_1 - V_0 \end{bmatrix} + \begin{bmatrix} Y_0 \\ U_0 \\ V_0 \end{bmatrix} \tag{7}$$

Similarly to the first embodiment, the outputted emphasized image information is transformed into the emphasized gray-scale level information by the gray-scale level information conversion part 6, and transmitted to the liquid crystal display 8 to be displayed on the liquid crystal display 8.

As described above, in the liquid crystal displaying method of the embodiment, even in the moving picture including the imaging defocus, the high-quality moving picture can be displayed on the liquid crystal display by the processing which is so easy that the moving picture data can be processed in real-time by the software.

(Sixth Embodiment)

The liquid crystal displaying method according to a sixth embodiment of the present invention is basically the same as the first embodiment, however, the frame rate of the input image information is different from the refresh rate of the liquid crystal display. Accordingly, the implementation apparatus implementing the liquid crystal displaying method of the sixth embodiment differs from the implementation apparatus implementing the liquid crystal displaying method of the first embodiment in the operation of the emphasis coefficient multiplying part 4.

Figure 12:
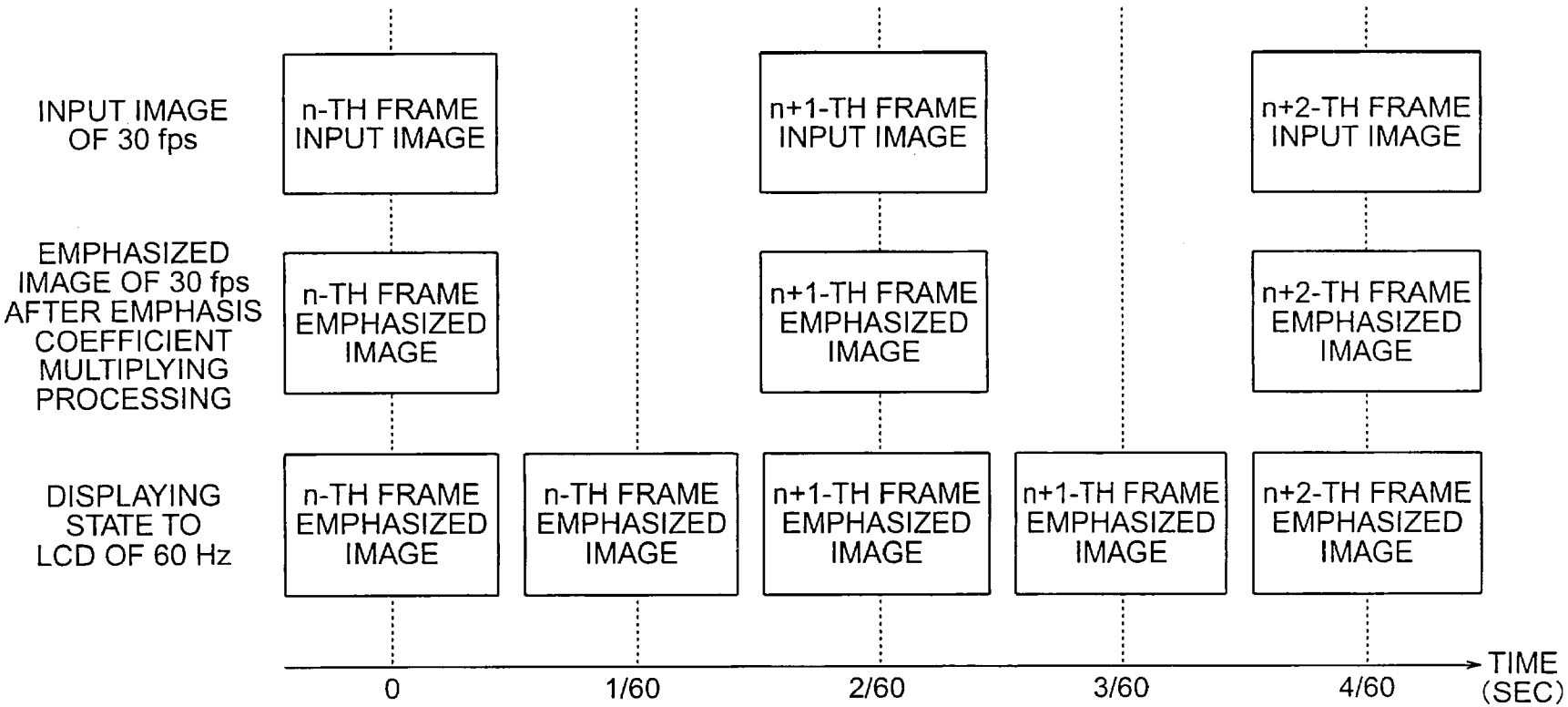
FIG. 12 is a view explaining a problem in the case that a frame rate of input image information is different from a refresh rate of a liquid crystal display.

The frame rate of the image information such as MPEG video data is generally 15 fps (frame per second) or 30 fps, on the other hand, the refresh rate of the liquid crystal display is generally 60 Hz. Therefore, for example, in the case that the same processing as the first embodiment is preformed to the input image having 30 fps by the emphasis coefficient multiplying part 4 and the input image having 30 fps is displayed on the liquid crystal display 8 having the refresh rate of 60 Hz, as shown in FIG. 12, the input image in which the emphasis coefficient multiplying processing has been performed is displayed twice for the refresh rate of 60 Hz of the liquid crystal display 8. That is to say, in the case that the emphasis coefficient α is calculated by the method described in the first embodiment, since the emphasis coefficient α is calculated so that the response of the liquid crystal display 8 is finished after 1/60 second as shown in FIG. 12, the input image, in which the response is finished after 1/60 second and the emphasis multiplying processing has been performed, is displayed twice for 1/30 second, so that the over-emphasis occurs.

Figure 13:
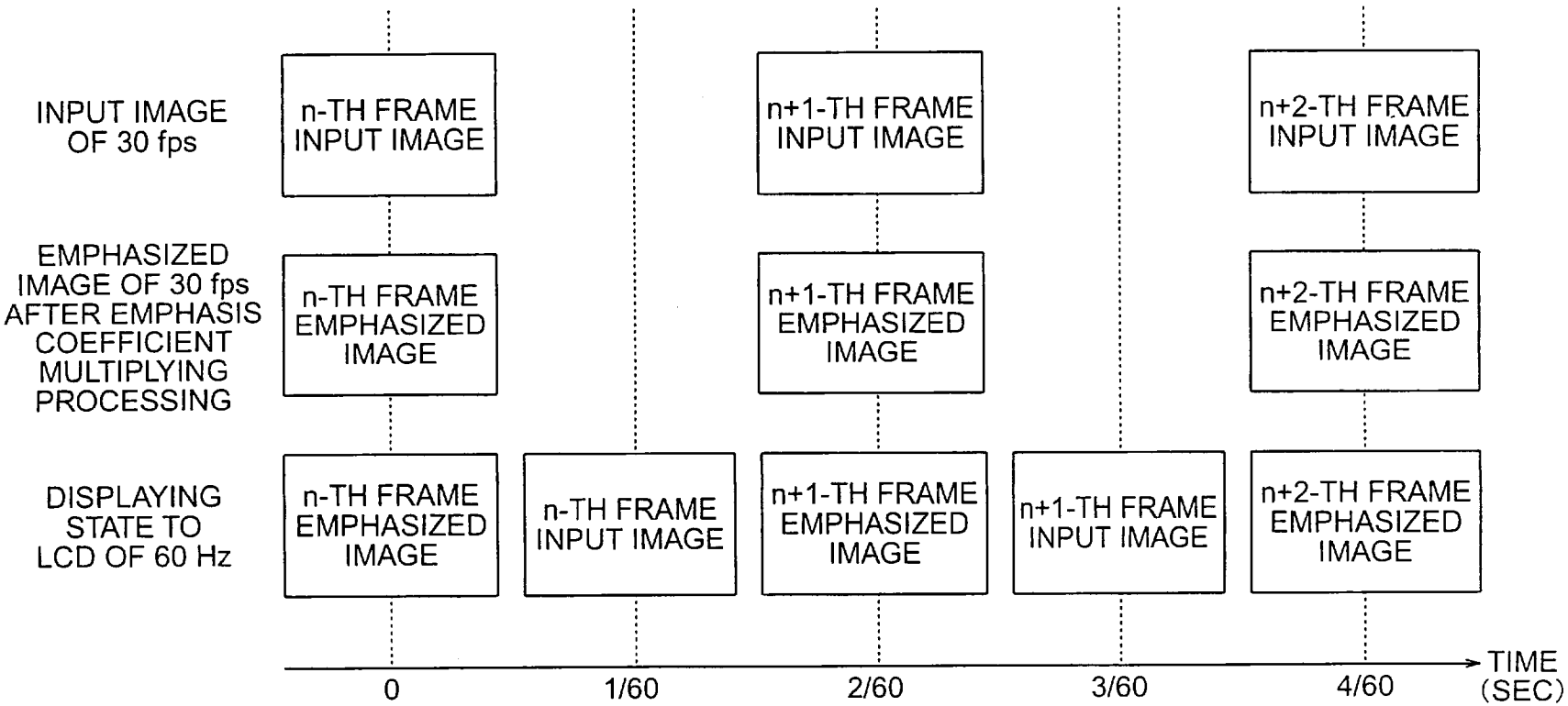
FIG. 13 is a view explaining operation of a liquid crystal displaying method according to a sixth embodiment of the present invention.
Figure 14:
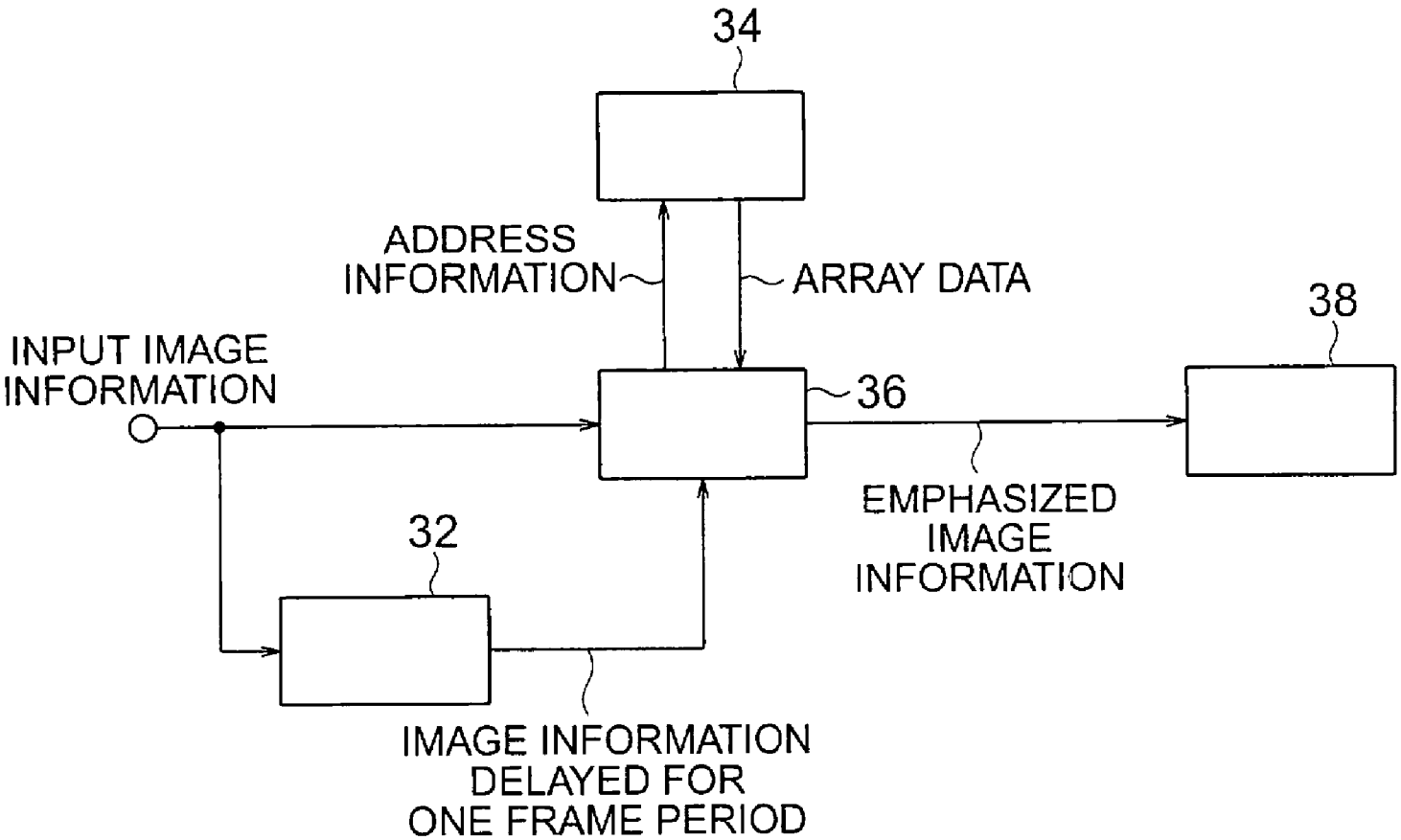
FIG. 14 shows a configuration of the related art.

In the embodiment, as shown in FIG. 13, when the display image of the liquid crystal display 8 changes from the input image of the n-th (n is an integer) frame to the input image of the n+1-th frame, the image in which the emphasis multiplying processing has been performed is displayed, and in other cases, the input image is continuously displayed as it is.

FIG. 13 shows the case that the input image having 30 fps is displayed on the liquid crystal display 8 having the refresh rate of 60 Hz. For example, when the image displayed on the liquid crystal display 8 changes from the image of the n-th frame to the image of the n+1-th frame, the emphasis image of the n+1-th frame is displayed, when the image of the n+1-th frame is continuously displayed, the image of the n+1-th frame is displayed as it is on the liquid crystal display 8. That is to say, when the input image information displayed on the liquid crystal display changes from an n-th frame (n is an integer) to an n+1-th frame, the brightness difference information obtained by subtracting the luminance information of the n-th frame from the luminance information of the n+1-th frame of the input image information and the chrominance difference information obtained by subtracting the color-difference information of the n-th frame from the color-difference information of the n+1-th frame of the input image information are respectively multiplied by the emphasis coefficient α, the emphasis image obtained by adding the luminance information of the n-th frame and the color-difference information of the n-th frame to the brightness difference information multiplied by the emphasis coefficient α and the chrominance difference information multiplied by the emphasis coefficient α, respectively, is displayed on the liquid crystal display, while the input image information is displayed on the liquid crystal display as it is when a display image does not change.

Thus, the emphasis coefficient multiplying processing is performed only in the case that the display image to the liquid crystal display 8 is changed, and the emphasis coefficient multiplying processing is not performed in other cases, so that the over-emphasis does not occur and the response of the liquid crystal display 8 can be completed within one frame period.

As described above, according to the liquid crystal displaying method of the embodiment, even in the case that the frame rate of the input image is different from the refresh rate of the liquid crystal display, the high-quality moving picture can be displayed on the liquid crystal display without over-emphasis by the processing which is so easy that the moving picture data can be processed in real-time by the software.

Though the preferred embodiments of the present invention are described, the present invention is not limited to the above-described embodiments, and various kinds of modification may be made without departing from the spirit and scope of the invention. Further, the embodiments includes various levels of the invention, various inventions may be extracted by properly combining disclosed structural requirements. For example, even if the some structural requirements are deleted from the disclosed structural requirements, it can be extracted as the invention if a given effect is obtained.

According to embodiments of the present invention, the high-quality moving picture without the blurring caused by the response characteristics of the liquid display can be displayed on the liquid crystal display by the processing which is so easy that the moving picture data can be processed in real-time by the software.

What is claimed is:

1. A liquid crystal displaying method, comprising:

multiplying a difference value of luminance information and a difference value of color-difference information each by an emphasis coefficient α (α is a positive real number), the difference value of the luminance information being the luminance information of input image information having the luminance information and the color-difference information subtracted from the luminance information in which the input image information has been delayed for one frame period, the difference value of the color-difference information being the color-difference information of the input image information subtracted from the color-difference information in which the input image information has been delayed for one frame period;

adding the luminance information in which the input image information has been delayed for one frame period and the color-difference information in which the input image information has been delayed for one frame period to the difference value of the luminance information multiplied by the emphasis coefficient α and the difference value of the color-difference information multiplied by the emphasis coefficient α, respectively, to obtain emphasized image information; and displaying the emphasized image information on a liquid crystal display apparatus.

2. The liquid crystal displaying method according to claim 1, further comprising:

in the case that gray-scale level of the liquid crystal display apparatus changes from an initial gray-scale level to an arrival gray-scale level, writing gray-scale level to the liquid crystal display apparatus for arriving at the arrival gray-scale level after one frame period is set to emphasized gray-scale level, and determining the emphasis coefficient α from a relationship between at least two difference values of gray-scale level obtained by subtracting each of at least two initial gray-scale levels from the arrival gray-scale level and at least two difference values of emphasized gray-scale level obtained from subtracting each of the at least two initial gray-scale levels from the emphasized gray-scale level.

3. The liquid crystal displaying method according to claim 1, wherein, in the case that all of the absolute difference value of the luminance information and the absolute difference value of the color-difference information of a certain pixel are lower than a predetermined value, the emphasis coefficient α of its pixel is a positive real number of not more than 1.

4. The liquid crystal displaying method according to claim 1, wherein, in the case that the absolute difference value of the luminance information of a certain pixel is lower than a predetermined value, the emphasis coefficient α of its pixel is a positive real number of not more than 1.

5. The liquid crystal displaying method according to claim 1, wherein the emphasis coefficient α is set by a user of the liquid crystal display apparatus.

6. The liquid crystal displaying method according to claim 1, wherein the emphasis coefficient α is determined from information type which indicates whether the input image information is imaged or not.

7. The liquid crystal displaying method according to claim 1, wherein, in case that a frame rate of the input image information is different from a refresh rate of the liquid crystal display apparatus, when the input image information displayed on the liquid crystal display apparatus changes from an n-th frame (n is an integer) to an n+1-th frame, multiplying the difference value of the luminance information obtained by subtracting the luminance information of the n-th frame from the luminance information of the n+1-th frame of the input image information by the emphasis coefficient α, multiplying the difference value of the color-difference information obtained by subtracting the color-difference information of the n-th frame from the color-difference information of the n+1-th frame of the input image information by the emphasis coefficient α, displaying, on the liquid crystal display apparatus, the emphasized image obtained by adding the luminance information of the n-th frame and the color-difference information of the n-th frame to the difference value of the luminance information multiplied by the emphasis coefficient α and the difference value of the color-difference information multiplied by the emphasis coefficient α, respectively, and, displaying, on the liquid crystal display apparatus, the input image information as is when a display image does not change.

8. The liquid crystal displaying method according to claim 2, wherein the emphasis coefficient α is obtained by a calculation of least squares.

9. The liquid crystal displaying method according to claim 2, wherein, in the case that all of the absolute difference value of the luminance information and the absolute difference value of the color-difference information of a certain pixel are lower than a predetermined value, the emphasis coefficient α of its pixel is a positive real number of not more than 1.

10. The liquid crystal displaying method according to claim 2, wherein, in the case that the absolute difference value of the luminance information of a certain pixel is lower than a predetermined value, the emphasis coefficient α of its pixel is a positive real number of not more than 1.

11. The liquid crystal displaying method according to claim 2, wherein the emphasis coefficient α is set by a user of the liquid crystal display apparatus.

12. The liquid crystal displaying method according to claim 2, wherein the emphasis coefficient α is determined from the information type which indicates whether the input image information is imaged or not.

13. The liquid crystal displaying method according to claim 2, wherein, in case that a frame rate of the input image information is different from a refresh rate of the liquid crystal display apparatus, when the input image information displayed on the liquid crystal display apparatus changes from an n-th frame (n is an integer) to an n+1-th frame, multiplying the difference value of the luminance information obtained by subtracting the luminance information of the n-th frame from the luminance information of the n+1-th frame of the input image information by the emphasis coefficient α, multiplying the difference value of the color-difference information obtained by subtracting the color-difference information of the n-th frame from the color-difference information of the n+1-th frame of the input image information by the emphasis coefficient $\alpha$, displaying, on the liquid crystal display apparatus, the emphasized image obtained by adding the luminance information of the n-th frame and the color-difference information of the n-th frame to the difference value of the luminance information multiplied by the emphasis coefficient $\alpha$ and the difference value of the color-difference information multiplied by the emphasis coefficient $\alpha$, respectively, and, displaying, on the liquid crystal display apparatus, the input image information as is when a display image does not change.

* * * * *